United States Patent [19]

Venti

[11] 4,039,097

[45] Aug. 2, 1977

[54] GLASS CONTAINER AND ADAPTER RING

[75] Inventor: Theodore Paul Venti, Grand Rapids, Mich.

[73] Assignee: Amway Corporation, Ada, Mich.

[21] Appl. No.: 694,332

[22] Filed: June 9, 1976

Related U.S. Application Data

[62] Division of Ser. No. 600,289, July 31, 1975, Pat. No. 3,994,709.

[51] Int. Cl.[2] ..... B65D 23/08

[52] U.S. Cl. ..... 215/12 R; 215/31

[58] Field of Search ..... 215/12 R, 31; 222/182, 222/183

[56] References Cited

U.S. PATENT DOCUMENTS

| | | | |
|---|---|---|---|
| 3,112,048 | 11/1963 | Finkenzeller | 222/183 |
| 3,124,273 | 3/1964 | Remington | 215/31 UX |
| 3,603,472 | 9/1971 | Lecinski | 215/31 X |

*Primary Examiner*—Donald F. Norton

*Attorney, Agent, or Firm*—Price, Heneveld, Huizenga & Cooper

[57] ABSTRACT

A nonaerosol container and a method for producing aerosol and nonaerosol containers having the same external appearance are disclosed. The method includes forming bottles from the same basic mold using different neck inserts with the nonaerosol bottle being formed with a continuous thread portion and both bottles including a transfer bead. A standard decorative overlay is formed. A resilient adapter ring is formed and permits the assembly of the overlay to the nonaerosol container in cooperation with the transfer bead. A valve retainer cap cooperates with internal ribs formed as part of the overlay to secure the overlay in the aerosol application.

6 Claims, 13 Drawing Figures

GLASS CONTAINER AND ADAPTER RING

CROSS-REFERENCE TO RELATED APPLICATION

This is a division of application Ser. No. 600,289, filed July 31, 1975 for Aerosol and Nonaerosol Glass Bottle System, now U.S. Pat. No. 3,994,709.

BACKGROUND OF THE INVENTION

This invention relates to both aerosol and non-aerosol glass bottle dispensers.

In the manufacture of aerosol type containers or dispensers particularly of the glass bottle variety, it has been common practice to place a decorative overlay on and around the upper portion of the container. The container generally has included an upper neck portion terminating in a rounded bead or collar. A valve unit is retained within the open end of the container by a crimped metal collar disposed over and around the rounded bead of the bottle. The decorative overlay generally includes a cylindrical sleeve portion and a depending skirt portion. The cylindrical sleeve portion may include a plurality of equally spaced inwardly directed ribs which contact the valve assembly and efficiently retain the ornamental overlay on the container. The skirt portion conceals head space which is necessary in aerosol containers to accommodate propellant. In glass bottles, that vacant space would otherwise be visible.

For marketing the same cosmetic or toiletry products in a nonaerosol container, head room is not necessary and smaller bottles can be used to market the same volume of product. Overlays are not necessary and in fact are not readily usable on glass nonaerosol bottles, and accordingly, a smaller bottle has to be used to market the same volume of product or else the empty space at the top of the bottle would detract from the marketability of the product. Due to the generally large variations in tolerances encountered during the manufacture of glass containers, the inwardly directed ribs of the metal overlay do not consistently retain the overlay to the nonaerosol container. On the aerosol container, the metal crimp collar employed to retain the valve assembly in the aerosol dispenser has reliable tolerances and provides a consistent match for the metal overlay. The crimp collar itself is crimped over a bead on the glass aerosol bottle and accordingly, the unreliable glass tolerances do not pose a problem for it, although some prior artisians have suggested the use of plastic inserts intermediate the crimp collar and bottle as tolerance insurance (See U.S. Pat. No. 3,112,048 to H. B. Finkenseller, entitled DECORATIVE RING AND FLEXIBLE INSERT FOR SPRAY CONTAINER, issued Nov. 26, 1963). Of course, the aerosol valve crimp collar is not available on a nonaerosol container.

Prior artisians have in the past attempted to assemble metal overlays to the continuous thread, nonaerosol bottles through the use of a foam, double back, pressure sensitive adhesive tape. The foam tape compensates for the dimensional tolerance differences in the bottles. The application of the foam double back tape is an extremely costly and difficult process because the tape must be hand applied around the perimeter of the bottle. This results in a reduction in the number of nonaerosol type containers which can be produced during a given time when compared to the production of the aerosol containers; an increase in overall manufacturing costs and an increase in the number of quality control rejections. For example, if the tape is unevenly applied, it may extend below the lower end of the depending skirt 48 of the decorative overlay 44. Further, the overlay 44 may be improperly oriented with respect to the bottle 12 upon assembly since it is not restrained against rotational movement about its horizontal axis. This orientation results in the production of an unsatisfactory container. It has, therefore, been very difficult and costly to employ the same basic bottle and the same decorative overlay for both aerosol and nonaerosol containers.

As a result, prior artisians have typically used two distincly different bottles and two distinctly different sets of costly bottle molds to provide for marketing comparable products volumes in aeresol and nonaerosol alternatives.

SUMMARY OF THE INVENTION

In accordance with the present invention, an improved method for the production of both aerosol and nonaerosol containers from the basic mold is provided as well as an improved, easily assembled nonaerosol container. Essentially, the same mold is employed for producing both aerosol and nonaerosol containers through the use of different neck inserts. One neck insert results in a container having an aerosol neck while another neck insert results in a bottle having a nonaerosol neck. The same decorative metal overlay including a cylindrical sleeve portion and a depending skirt portion is adapted for use with the nonaerosol container as well as the aerosol container by a cylindrical, resilient adapter ring. This greatly reduces the mold costs for an aerosol and nonaerosol packaging system for a given product.

Preferably, the resilient adapter includes a plurality of equally spaced, inwardly directed ribs. Each rib terminates at its lower end with an inwardly directed hook-like portion. The ring-like adapter is press fit within the cylindrical sleeve of the decorative overlay and the sleeve with the adapter may then be press fit over the upper portion of the nonaerosol container. The ribs employed on the adapter ring serve to compensate for the dimensional variations in the glass bottle and for the absence of the metal crimp collar employed only with the aerosol type dispenser. The hook-like configuration at the lower portion of each rib locks under the bead formed as part of the bottle, thereby preventing the decorative overlay assembly from being pulled or otherwise removed from the top of the bottle.

DETAILED DESCRIPTION OF THE PREFERRED EMBODIMENT

Figure 1:
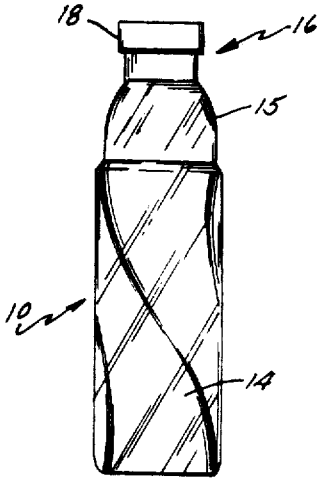
FIG. 1 is an elevational view of an aerosol bottle employed with the subject invention.
Figure 2:
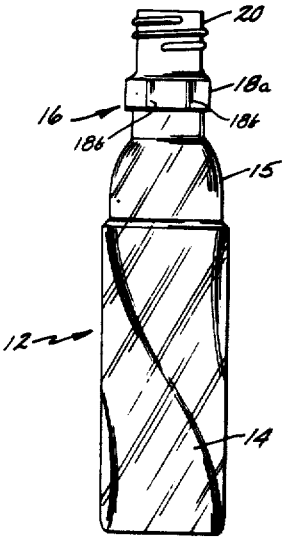
FIG. 2 is an elevational view of a nonaerosol bottle employed with the subject invention.
Figure 3:
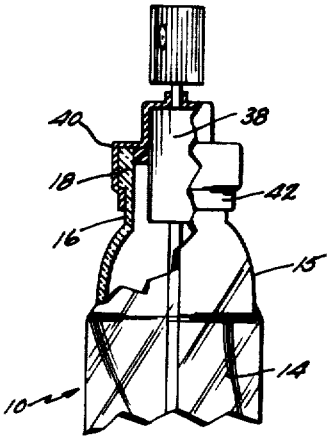
FIG. 3 is a side elevation, in partial cross-section showing a valve secured to the aerosol bottle of FIG. 1.
Figure 11:
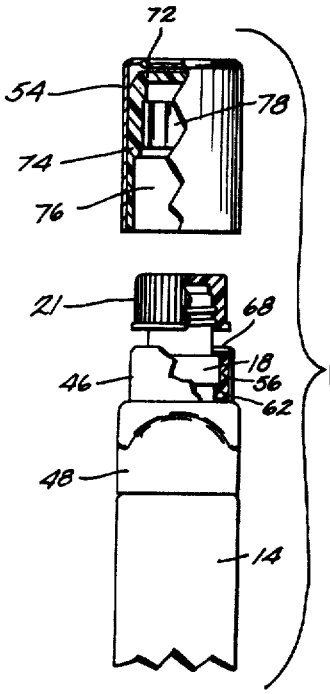
FIG. 11 is a front elevational view of the completed nonaerosol container in accordance with the present invention.

As best seen in FIGS. 1, 2 and 3, the containers in accordance with the present invention take the form of an aerosol bottle 10 and a nonaerosol bottle 12. Both of these bottles include a main body portion 14, a shoulder portion 15 and a neck portion 16 including a transfer bead or rounded collar 18 and 18*a* respectively, both being similar. The nonaerosol bottle 12 further includes a threaded portion 20 formed above the transfer bead 18 and adapted to receive a closure cap 21 (FIG. 11).

Figure 12:
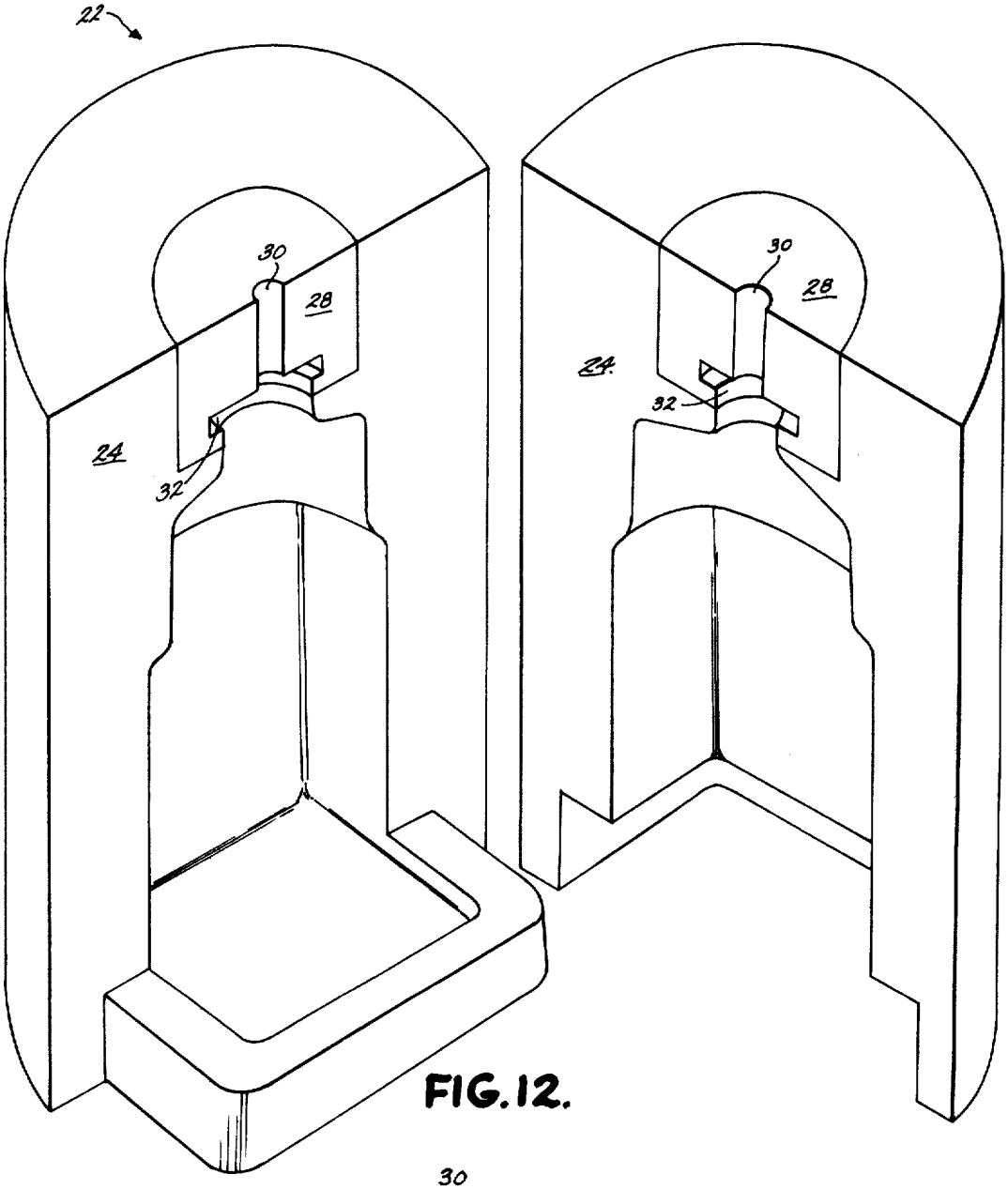
FIG. 12 is an illustration of a representative mold which can be employed with the present invention including an aerosol neck insert.

Both glass bottles may be formed in a mold 22 illustrated in FIG. 12. The mold 22 includes a pair of mold halves 24 which close over a base plate 26. As shown in FIG. 12, a neck ring insert 28 including a flow passage 30 and a bead forming groove 32 is disposed within the upper portion of each mold half 24 when forming the aerosol container of FIG. 1.

Figure 13:
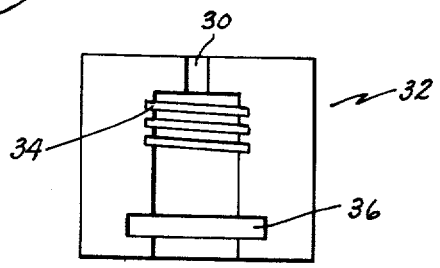
FIG. 13 is a front, elevational view of a threaded neck insert to be employed with the mold of FIG. 12 for producing a nonaerosol container.

In forming the nonaerosol container having a continuous thread finish, the neck insert 32 is substituted for the neck insert 28. As shown in FIG. 13, the neck insert 32 includes grooves 34 for forming the cap receiving threads and a groove 36 for forming the bead 18*a*. Groove 36 is slightly smaller than groove 32 in aerosol neck insert 28 so that a nonaerosol bottle is formed with a slightly smaller bead 18*a*. This accommodates the fact that resilient adapter ring 56 has slightly thicker walls than crimp collar 40 and results in adapter ring 56 and crimp collar 40 having the same external peripheral dimensions when assembled to their glass bottles. Also, the nonaerosol bottle bead 18*a* includes small protruding ribs 18*b* which nominally interfere with the interior ribs 58 on adapter ring 56 to prevent rotation of adapter ring 56. There are six regularly spaced ribs 18*b* and eight regularly spaced ribs 58.

In use, the appropriate neck insert 28 or 32 is placed within the recess formed in each body mold 24 and the body molds are clamped together. Once the body mold 24 is assembled, the molten glass may be poured through the flow passage 30 and the glass container formed by a conventional blow molding operation.

As shown in FIG. 3, when an aerosol dispenser is desired a conventional aerosol valve 38 is retained within the open end of the neck 16 of the bottle by a crimp type metal collar 40. The metal crimp collar 40 is crimped along its lower edge 42 so as to lock collar 40 and valve 38 to the transfer bead 18 and within the open neck 16, respectively.

Figure 4:
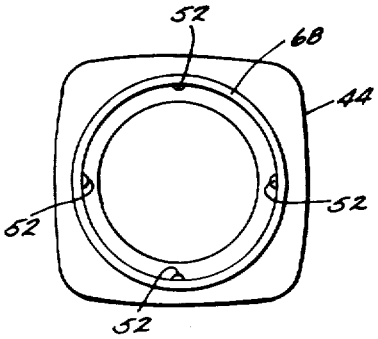
FIG. 4 is a plan view of a decorative overlay in accordance with the present invention.
Figure 5:
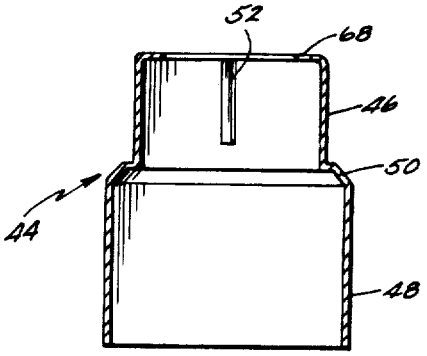
FIG. 5 is a front elevational cross-sectional view of the overlay of FIG. 4.

With reference to FIGS. 4 and 5, the standard decorative metal overlay 44 is shown as including a cylindrical sleeve portion 46 and a depending skirt portion 48. The skirt portion 48 is formed integral with the sleeve 46 and includes a stepped area 50 dimensioned so that the overlay 44 will cover the neck area of the aerosol bottle 10 or the nonaerosol bottle 12, the shoulder portion 15 and the upper end of the main body portion 14 of each bottle.

The cylindrical sleeve 46 of the overlay 44 is formed with a plurality of inwardly directed ribs 52. These ribs 52 are dimensioned so as to frictionally engage the metal crimp collar 40 when employed with the aerosol bottle 10.

Figure 6:
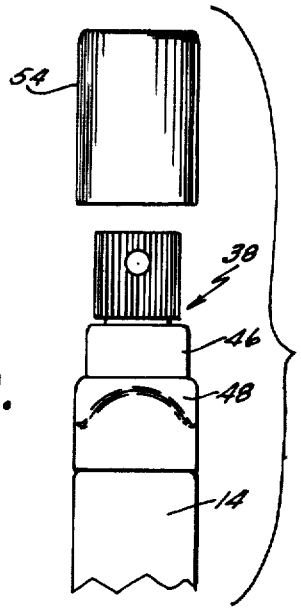
FIG. 6 is a front elevational view of the completed aerosol bottle in accordance with the present invention.

As shown in FIG. 6, the finished aerosol container has the decorative overlay 44 press fit on its upper portion over crimp collar 40 and an overcup 54 is employed to cover the actuator of the valve 38. The cap 54 is more fully described below.

Figure 7:
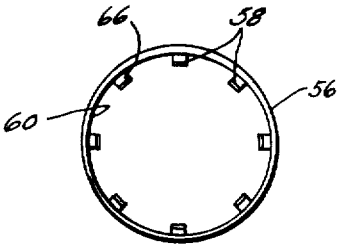
FIG. 7 is a plan view of the adapter ring in accordance with the present invention.
Figure 8:
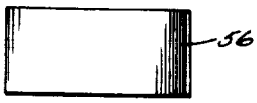
FIG. 8 is an elevational view of the ring of FIG. 7.
Figure 9:
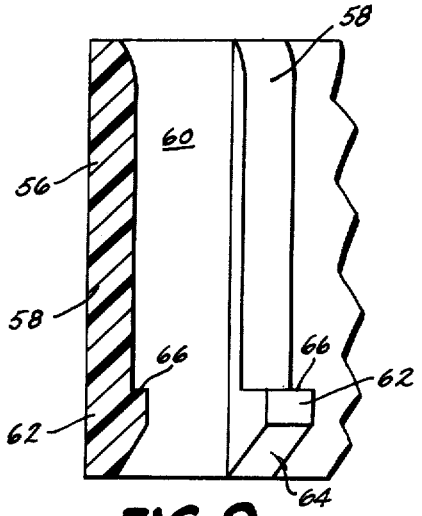
FIG. 9 is a fragmentary, partial cross section of the adapter ring of FIG. 8.

Due to the manufacturing tolerances involved in the production of the bottles and due to the fact that a metal crimp collar 40 is employed only in the aerosol application, the decorative overlay 44 may not be adequately secured directly to the nonaerosol bottle. Accordingly, the adapter ring 56, illustrated in FIGS. 7, 8 and 9, is provided to permit the employment of the same decorative overlay 44 for nonaerosol applications. The ring 56 is formed with a generally cylindrical shape and includes a plurality of inwardly directed ribs 58 formed on its inner periphery 60. As best seen in FIG. 9, the ribs 58 terminate at their lower ends with inwardly directed hook-like portions 62. The hook-like portions 62 include a beveled bottom surface 64 and a flat retaining surface 66.

The adapter ring 56 may be molded from any suitable thermoplastic material such as polypropylene or polyethylene. It is preferred, however, that polymeric be employed. It is necessary that the ring have sufficient resilience so as to assume a press fit within the cylindrical sleeve portion 46 of the overlay 44 and still be capable of sufficient deformation to permit the hook portion 62 of the ribs 58 to be pressed over the transfer bead 18 of the nonaerosol bottle 12. Also, adapter 56 must be sufficiently pliable to accommodate tolerance deviations in the glass bottle and still have a relatively contant outer dimension to fit snugly within overlay 44.

Figure 10:
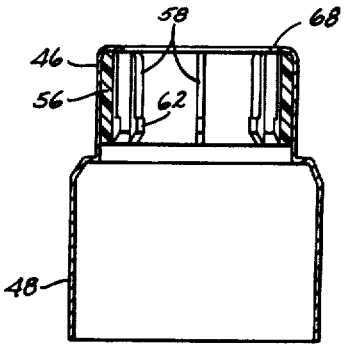
FIG. 10 is a front elevation, in cross section of the adapter ring decorative overlay assembly.

As shown in FIG. 10, the adapter ring 56 is inserted through the depending skirt 48 of the overlay 44 and into sleeve portion 46. Sleeve 46 of the overlay 44 terminates in an inwardly directed top flange 68. The adapter ring 56 is pressed into the overlay 44 until its upper edge abuts the flange 68.

As best seen in FIG. 11, the overlay 44 including the adapter ring 56 is then press fit to the bottle 12. The beveled bottom surface 64 of hook portions 62 readily allows the ring-overlay assembly to slip into the bottle. The retaining surfaces 66 on the ring 56 locks the overlay 44 to the transfer bead 18*a*, preventing removal. The shape of the ribs 52 of the ring 56 insure even contact with the transfer bead 18*a* regardless of the initial orientation of the assembly upon fitting to the bottle. This feature eliminates any possibility of horizontal, rotational misalignment after assembly. In assembling the ring 56 to the overlay, it must be flush with the flange 68 in order that the overlay fits properly on the shoulder 15 of the bottle after assembly. Finally, closure cap 70 is threadably secured to the portion 20 of the bottle 12.

The decorative overcap 54, as best seen in FIGS. 6 and 7, is used with either the aerosol container or the nonaerosol container. The overcap 54 may be formed from a metal and assumes a cylindrical shape.

A resilient, thermoplastic insert 72 fits snugly within the overcap 54. The insert 72 includes a stepped interface 74 around its inner periphery. Thus the inner wall of the insert 72 has a greater diameter at its lower wall portion 76 than at its upper wall portion 78. The lower wall 76 is dimensional so as to fit over the cylindrical sleeve portion of the metal overlay 44 thereby retaining the overcap 54 to the aerosol container.

The upper wall portion 76 frictionally engages the screw cap on closure cap 21 of the nonaerosol container. As a result, rotation of the overcap 54 also rotates the closure cap 21 for removal or attachment. In practice, insert 72 is molded slightly different for use on nonaerosol containers than on aerosol, in that an enlarged pin is used in the mold for insert 72 to make the insert lower wall 76 slightly thinner than it is when inserted 72 is to be used on aerosol containers. Correspondingly, this makes this insert diameter slightly larger at lower wall than sleeve portion 46 of overlay 44 and prevents interference with the turning motion of overcap 54 when threading cap 21.

It is readily apparent that the present invention provides a method for the production of aerosol and nonaerosol containers from the same basic mold and possessing the same external appearance and employing the same decorative overlay. The adapter ring is easily assembled to the decorative overlay permitting the same to be employed on the nonaerosol bottle.

Of course, it is understood that the above is merely a preferred embodiment of the invention and that various changes and alterations can be made in the structure without departing from the spirit and broader aspects of the invention.

The embodiments of the invention in which an exclusive property or privilege is claimed are defined as follows:

1. A glass container comprising:

a bottle having a body and a neck with a bead generally adjacent said neck;

a resilient adapter ring having a plurality of spaced, inwardly projecting ribs engaging said bead, each said rib being narrow relative to the circumference of said adapter ring;

a decorative overlay including a cylindrical sleeve portion, said cylindrical sleeve portion fitting over and snugly engaging said resilient adapter ring;

said bead defining an inwardly projecting under surface;

each of said ribs on said resilient adapter ring including an inwardly projecting hook generally at the bottom thereof, said inwardly projecting hook extending inwardly underneath said under surface of said bead whereby inadvertent removal of said resilient adapter ring from said glass container is prevented;

each of said inwardly projecting hook including a beveled bottom surface to facilitate sliding said hook portions over said bead when said adapter ring is fitted over said bead; and each of said hooks including a flat, generally horizontal upper retaining surface engaging said under surface of said bead.

2. The glass container of claim 1 in which said overlay includes a plurality of spaced, inwardly projecting ribs on said sleeve portion, said ribs engaging said resilient retainer ring.

3. The glass container of claim 1 comprising:

said neck including threads;

a threaded cap threaded onto said threads of said neck;

said threaded cap having exterior peripheral dimensions narrower than the exterior peripheral dimensions of said sleeve of said overlay;

a decorative overcap upper and lower interior wall portions, said upper interior wall portions being narrower than said lower interior wall portions and having dimensions corresponding generally to those of said threaded cap such that said upper interior wall portions engage the exterior peripheral surface of said threaded cap and said lower interior wall portions having dimensions slightly larger than the dimensions of said exterior peripheral portions of said sleeve of said overlay.

4. The glass container of claim 3 in which said decorative overcap comprises an exterior metal sleeve and a molded insert, said insert defining said upper and lower interior wall portions of said decorative overcap.

5. The glass container of claim 1 in which said bead includes a plurality of vertical ribs protruding from its surface and interfering with said inwardly projecting ribs on said adapter ring to prevent rotation thereof.

6. The glass container of claim 5 in which there are eight of said inwardly projecting ribs on said adapter ring and six said vertical ribs on said bead.

* * * * *